US008308205B2

(12) United States Patent
Tejszerski

(10) Patent No.: US 8,308,205 B2
(45) Date of Patent: Nov. 13, 2012

(54) TOGGLE LATCH

(75) Inventor: Filip Tejszerski, Newport (AU)

(73) Assignee: D & D Group Pty Ltd, Frenchs Forest (AU)

( * ) Notice: Subject to any disclaimer, the term of this patent is extended or adjusted under 35 U.S.C. 154(b) by 551 days.

(21) Appl. No.: 12/349,005

(22) Filed: Jan. 6, 2009

(65) Prior Publication Data

US 2010/0026016 A1 Feb. 4, 2010

Related U.S. Application Data

(63) Continuation-in-part of application No. 29/323,906, filed on Sep. 3, 2008, now Pat. No. Des. 605,493.

(51) Int. Cl.
*E05C 3/02* (2006.01)
*E05C 3/12* (2006.01)

(52) U.S. Cl. ..... 292/230; 292/231; 292/237; 292/238; 292/340

(58) Field of Classification Search ..... 292/230, 292/231, 237, 238, 259 R, 340, 341.15, 359
See application file for complete search history.

(56) References Cited

U.S. PATENT DOCUMENTS

| | | | | | |
|---|---|---|---|---|---|
| 745,720 | A * | 12/1903 | Erickson | 292/136 |
| 1,014,290 | A * | 1/1912 | Frantz | 292/230 |
| 1,638,249 | A * | 8/1927 | Ferris | 292/237 |
| 1,703,249 | A * | 2/1929 | Schrader | 292/332 |
| 1,765,615 | A * | 6/1930 | Roedding et al. | 292/332 |
| 1,781,172 | A * | 11/1930 | Graf | 292/332 |
| 1,880,985 | A * | 10/1932 | Saunders | 81/3.09 |
| 1,883,216 | A * | 10/1932 | Winters | 81/3.09 |
| 2,644,708 | A * | 7/1953 | Poole | 292/236 |
| 2,683,049 | A * | 7/1954 | Van Der Spek | 292/207 |
| 2,794,663 | A * | 6/1957 | Grodt et al. | 292/67 |
| 6,679,530 | B2 * | 1/2004 | Krynski | 292/210 |
| 6,945,575 | B2 * | 9/2005 | Thompson | 292/340 |
| 2010/0045055 | A1 * | 2/2010 | Taglianetti | 292/341.15 |

* cited by examiner

*Primary Examiner* — Carlos Lugo
(74) *Attorney, Agent, or Firm* — Kelly & Kelley, LLP

(57) ABSTRACT

A toggle latch for a gate has a first unit mounting a pivotal latch arm and adapted to be mounted on the gate and a second unit providing a receiving and latching cavity and adapted to be mounted on a gate post, the body portion of the second unit having a forward nose to provide a ramp to deflect upwardly and over the nose the latch arm when impacting thereon and an interior retaining surface defined in the body and having upper and rear surfaces of the cavity to deflect down into the cavity the latch arm after it has ridden up over the nose.

12 Claims, 6 Drawing Sheets

SECTION C-C

SECTION B-B

SECTION A-A

TOGGLE LATCH

BACKGROUND OF THE INVENTION

The present invention relates to a toggle latch the typically application being to exterior gates where, on closing of the gate, there is automatic latching.

Toggle latches are known for gates and wherein a pivotal bar strikes on a closure ramp to be deflected upwardly and then drops down into a receiving cavity for latching purposes. Manual operation is usually provided for lifting the bar to undo the latch so the gate may be open.

Typically such toggle latches are made of metal components and usually are of a relatively crude and inexpensive form of construction.

SUMMARY OF THE INVENTION

The present invention is directed to new and useful alternative designs of toggle latches and lends itself to embodiments which may be assessed as having improved functionality, performance and can be implemented with superior industrial design.

Broadly the present invention is directed to a toggle latch for latching together first and second structures when in juxtaposition for latching at a closed position, the latch comprising a first unit having a body for mounting on the first structure, a pivotally mounted latch arm projecting laterally and pivotal about a substantially horizontal axis, a support for supporting the latch arm when free to limit normally downward pivoting of the latch arm, a second unit for mounting on the second structure and receiving in latching engagement the latch arm, the second unit having a body portion within which a laterally directed aperture is defined for admitting the latch arm and a cavity for retaining the latch arm in latching engagement, the body portion being characterized by a forward nose providing a ramp to deflect upwardly and over the nose the latch arm when impacting thereon, and an interior retainer surface defining upper and rear surfaces of the cavity and profiled to deflect down into the cavity the latch arm after it has ridden up over the nose.

Each of the units may be formed by molding for example in plastics to have an elongate body which may be of the order of 2 cm wide and having apertures for receiving fixing screws to be attached to the face of a gate and gate post. Each unit may be several centimeters in vertical extent and the invention can readily be implemented in a unit wherein the pivotal toggle latch arm can extend to the right or the left from the body, which is designed to be symmetrical and capable of inversion for mounting purposes.

A particularly advantageous embodiment is one wherein the surfaces defining the cavity for receiving a latching arm have a complex curve with a decreasing radius of curvature through the posterior surface and back towards a forward surface which is on the rear of the portion defining the forward nose for the deflecting ramp.

An embodiment of the invention will be described hereinafter for illustrative purposes only. In such an embodiment the latch may be described as being further characterised by a superior surface of the cavity having a lead-in surface above the ramp and extending rearwardly substantially horizontally and smoothly blending into an actuate posterior surface with a vertical gap between the rear, upper portion of the ramp to the superior surface of about 1.3 times the diameter of the latch arm and a horizontal gap between the end of the ramp and the posterior actuate surface of about 1.3 times the diameter of the latch arm.

DETAILED DESCRIPTION OF THE PREFERRED EMBODIMENT

Figure 1:
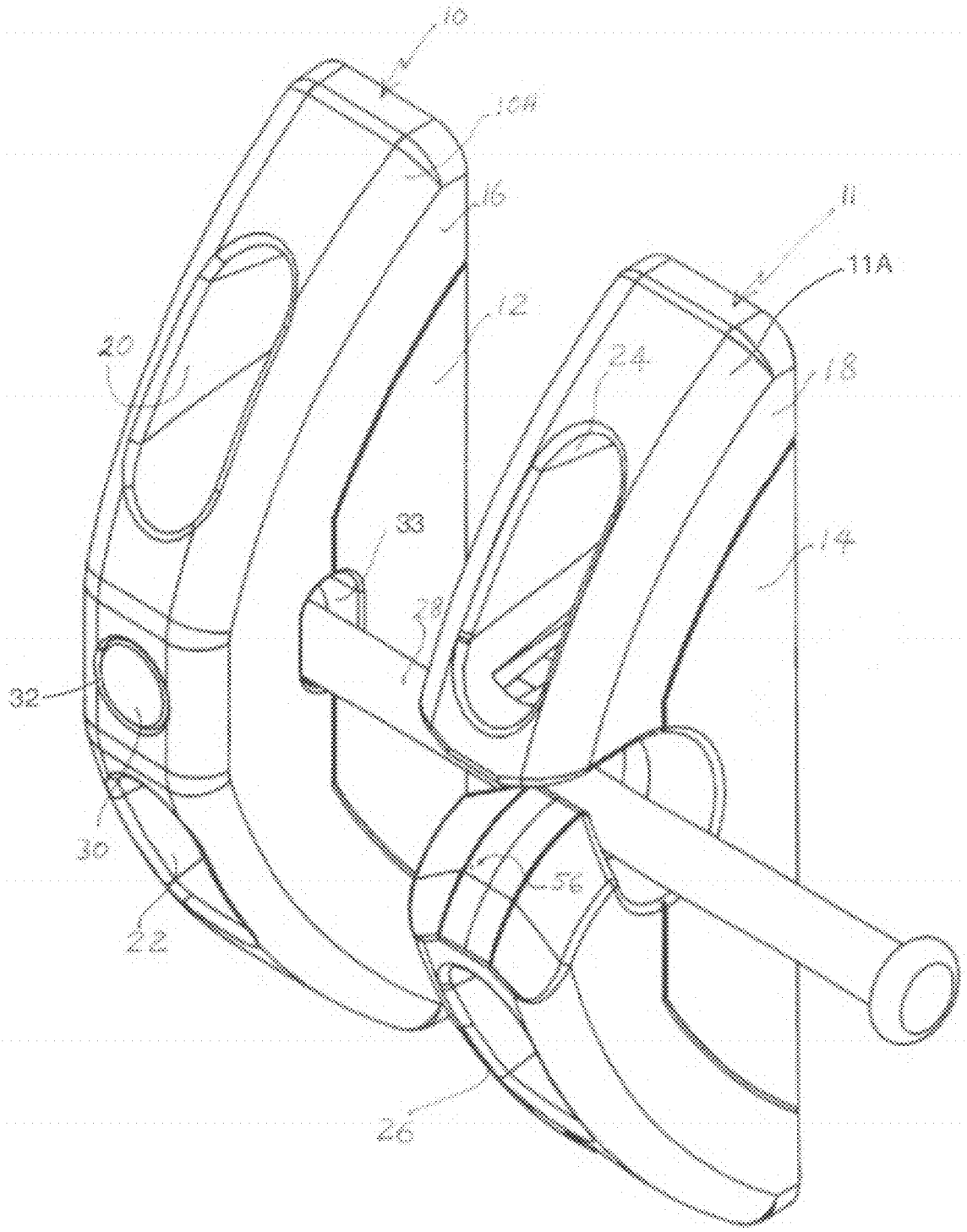
FIG. 1 is an isometric front view from the right of a toggle latch embodying the invention.
Figure 2:
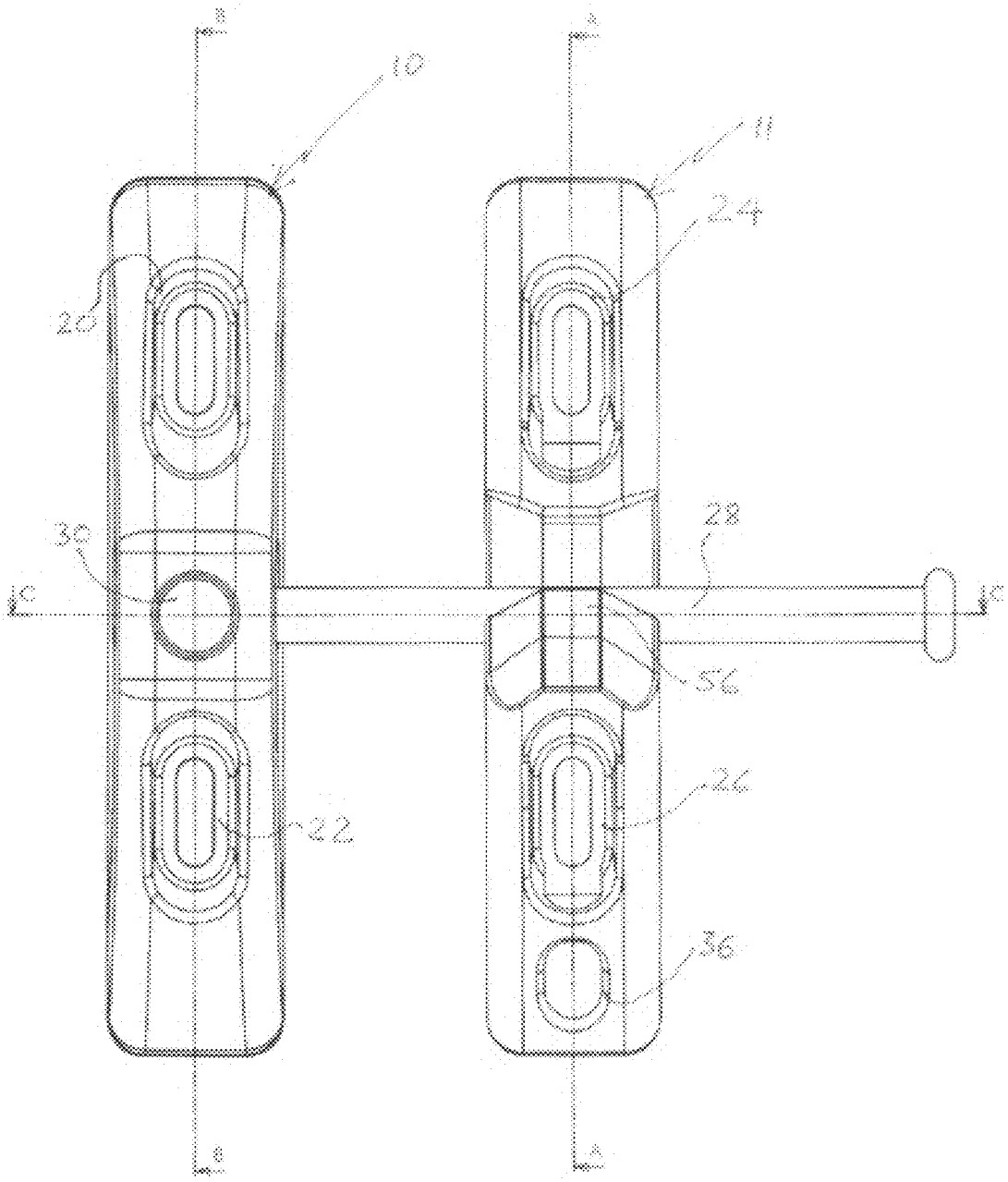
FIG. 2 is a front elevation of a toggle latch.
Figure 3:
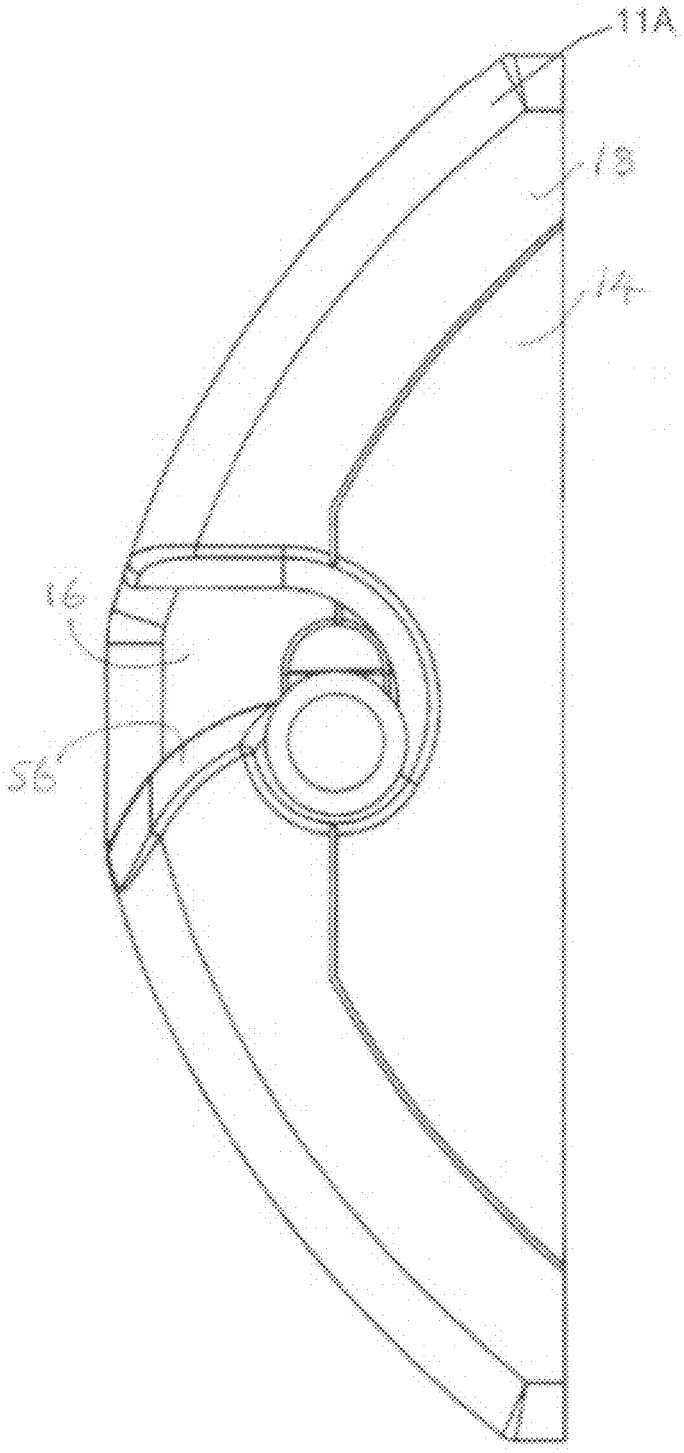
FIG. 3 is a right hand side elevation of the toggle latch.
Figure 4:
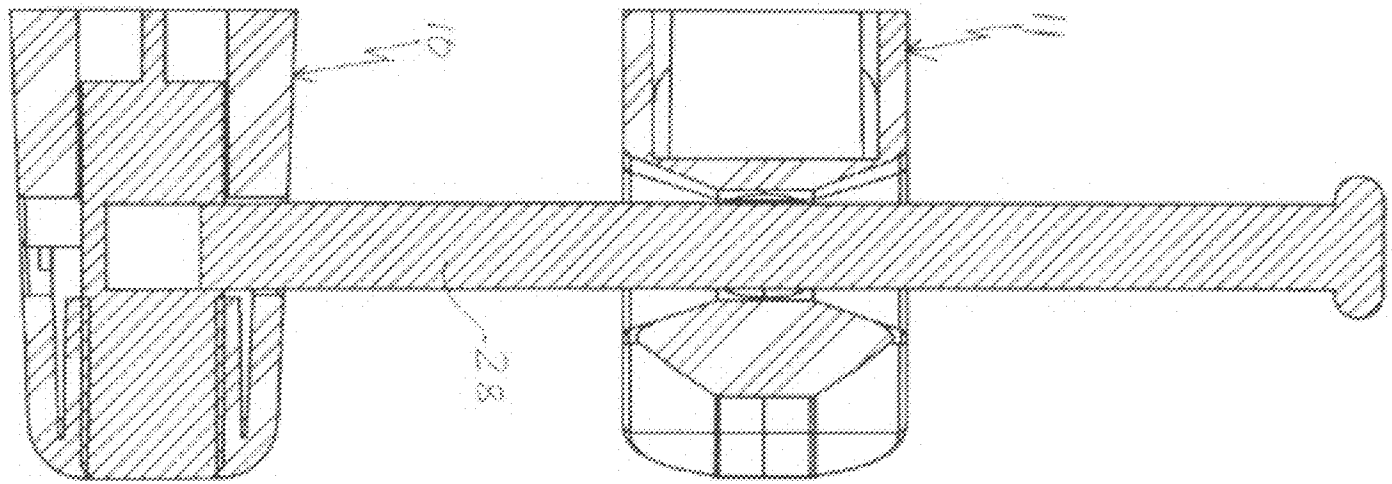
FIG. 4 is a sectional plan view along the line C-C of FIG. 2.

The toggle latch comprises a toggle latch unit 10 and a receiving unit 11 each having a housing with flat rear walls and adapted to be face mounted respectively on the edge of a gate and a gate post. Each of the units comprises an interconnected plastic two part body having a central back portion respectively 12 and 14 and an overlying curved front portion 16 and 18 providing respective housings 10A and 11A with upper and lower apertures 20 and 22 in the first unit 10 and 24 and 26 in the receiving unit 11. The apertures provide access for a screw driver to fit fixing screws through the base of each unit for mounting units.

Figure 5:
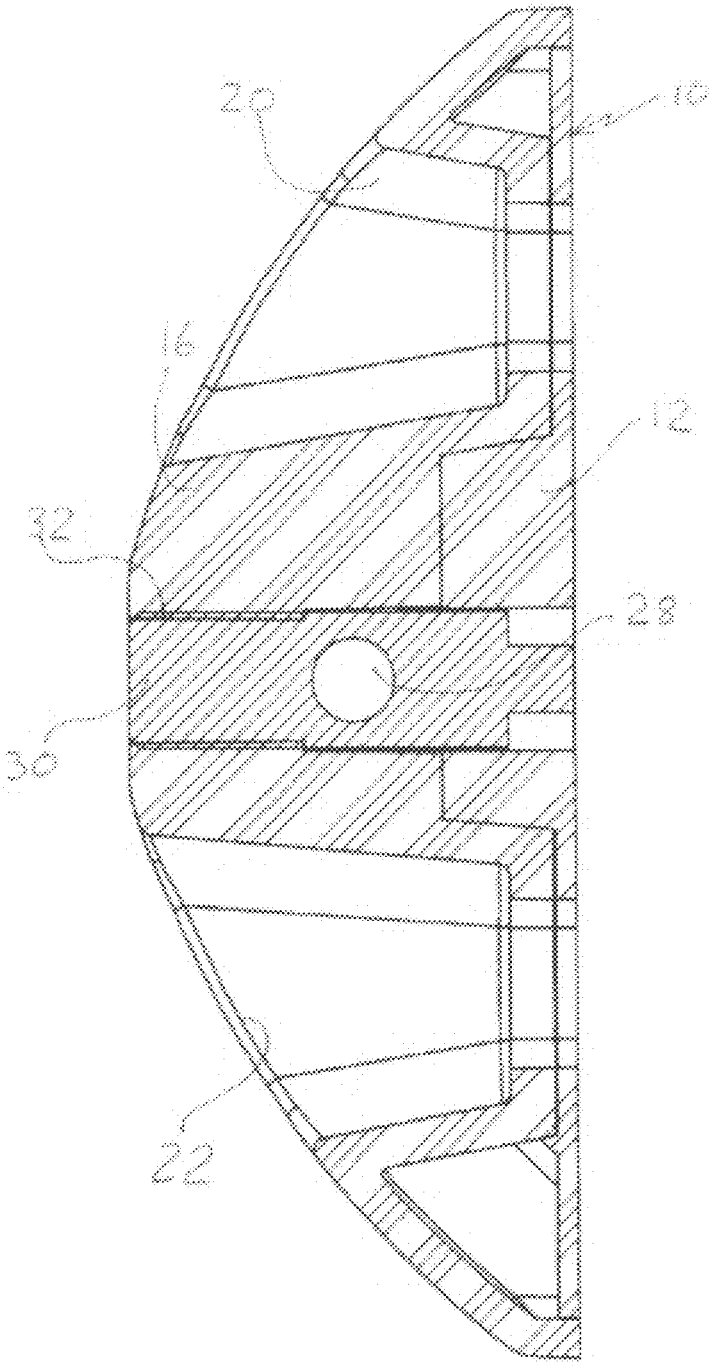
FIG. 5 is a section along the line B-B and being a central side elevation of the first unit mounting the toggle arm.

The toggle unit 10 has a pivotal toggle arm 28 typically of a suitable steel which is protected against corrosion and which is press fitted to and welded to a transverse circular cross section barrel 30 which has been located in a receiving cavity 32 in the molded body of parts 12 and 16 of the housing 10A. From FIG. 5 it would be apparent that the leading end of the barrel 30 has a chamfered face and engages rotatably behind a corresponding undercut lip of the cavity 32, the opposite end of the barrel 30 having a reduced dimension tab which is retained in a position after fitting to the toggle arm 28.

As most clearly shown in FIG. 1, an oval aperture 33 extends from the right hand face of the unit 10 through the body to intercept with the cavity 32 accommodating the barrel 30. In use the latch arm 28 falls under gravity and when the gate is open can rest on the lower edge of the aperture 33, but during closure of the gate the latch arm 28 moves towards the upper extremity of the oval aperture 33. In the event that installation requires the toggle arm to be on the right of the receiving unit 11, then the unit 10 is inverted compared with the position shown in FIG. 1 and installation can occur with the latch arm 28 being arranged to latch and extend to the opposite side of the unit 11 compared with that shown in FIG. 1.

Figure 6:
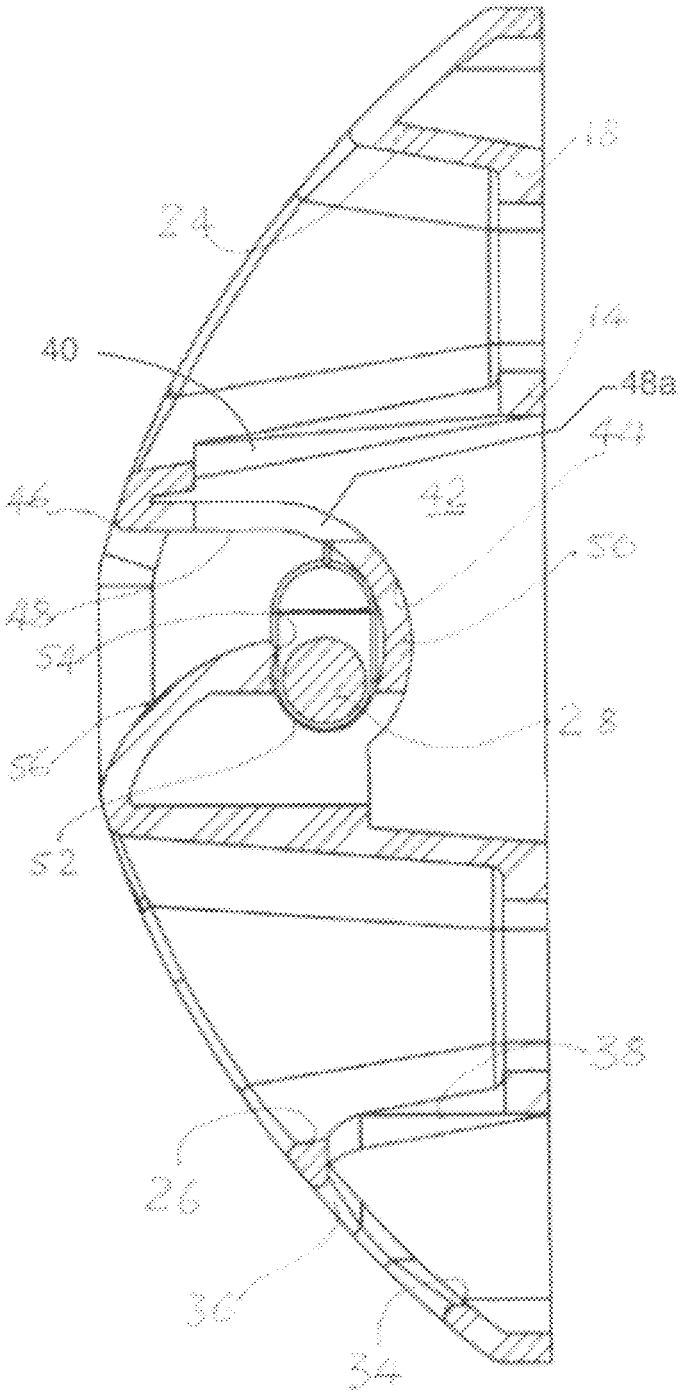
FIG. 6 is a sectional side elevation taking along the line A-A of FIG. 2 and through the second unit.

The receiving unit 11, as best shown in FIG. 6, has an additional lower aperture 34 formed in the body and having an opening 36 in the lower facia and an opening 38 in the central wall dividing the lower cavity 24 from the aperture 26. This is intended to permit a padlock to be stored with the hasp thereof extending through e.g. the opening 26, then down through the aperture 38 and back out of the opening 36 so the padlock may be stored when not in use in a closed condition if desired.

In the upper region, the receiving unit has a further aperture 40 defined in the wall separating the upper aperture 24 and a central cavity 42. An interior curved wall 44 extends from a main aperture 46 for admitting the toggle arm 28 past a superior wall 48 to an anterior wall 50 to then rest upon an inferior wall 52. A padlock hasp may thus be inserted through into the aperture 24, down through the aperture 40 and then through the superior aperture 48*a* to be locked in position thereby preventing removal of the latch arm 28 from the latching position shown in FIG. 6.

It will be seen that the superior wall 48 is substantially horizontal and rearwardly directed to blend into a smoothly curved anterior wall 50 with a slight decrease in the radius of curvature round the inferior wall 52 and the base of the toggle arm 28 to curve upwardly into an undercut or lip arrangement 54.

Thus, there is a substantial clearance between the toggle arm 28 when it moves up the ramp surface 56 and the superior wall 58; on any impact of the toggle arm 28, with the anterior wall 50 it is deflected forwardly and downwardly to adopt the position shown in FIG. 6 where retention occurs with the toggle arm 28 located under gravity.

Typically the gap or clearance is such that the spacing between the lip 54 and the superior wall 48 above and anterior wall 50 behind is about 1.3 times the diameter of the toggle arm 28.

It will be appreciated that the present invention lends itself readily to suitable styling and molded plastics material is preferable for both the units; the units can be complementary in form and general shape. The width of each unit (about 2 cm) lends itself to secure face mounting in a manner which can be functionally effect and advantageous. The height of each unit can be around 10 cm.

Furthermore by using glass-reinforced plastics material considerable strength, robustness and resistance to corrosion is provided. The barrel and latch arm can readily be made of the selected steel which is resistant to corrosion.

The materials chosen can lend themselves to a long period of service without maintenance.

What is claimed is:

1. A toggle latch for latching together first and second structures when in juxtaposition for latching at a closed position, the toggle latch comprising:

a first unit having a body for mounting on the first structure, the body having a receiving cavity with lateral apertures at opposite sides of the body;

a support received in the receiving cavity, the support having a support cavity;

a latch arm having one end mounted on the support cavity and an opposite end projected laterally through one of the apertures of the body, the latch arm being configured to pivot about a latch arm axis;

a second unit for mounting on the second structure and receiving in latching engagement the latch arm, the second unit having a body portion within which a laterally directed aperture is defined for admitting the latch arm and a cavity for retaining the latch arm in latching engagement; and the body portion being characterized by a ramp surface profiled to pivot the latch arm upward when impacting thereon, and an interior curved wall defining superior and anterior walls profiled to pivot the latch arm down to an inferior wall in the cavity;

the superior wall has a lead-in surface above the ramp surface that extends rearwardly and substantially horizontally smoothly blending into the anterior wall with a vertical gap between the superior wall and the ramp surface;

wherein the first unit is configured to be invertible so that when installed with respect to the second unit position, the latch arm may be directed to the left or to the right through a respective aperture of the body towards the second unit.

2. A toggle latch as claimed in claim 1, wherein the body portion of each of the first unit the second unit is molded in plastics material.

3. A toggle latch as claimed in claim 1 wherein the first unit comprises two spaced supports for the latch arm.

4. A toggle latch as claimed in claim 1, wherein the superior, anterior and inferior walls follow a smooth curve decreasing in radius of curvature generally from the superior wall through the anterior wall to the inferior wall.

5. A toggle latch as claimed in claim 1, wherein the ramp surface is a ridge centrally disposed in the body of the second unit.

6. A toggle latch as claimed in claim 5, wherein the ramp surface has lateral sides tapering towards a lip of the cavity.

7. A toggle latch as claimed in claim 1, wherein the body of the first unit and body portion of the second unit are elongated in a vertical direction when installed with holes for fixing screws in upper and lower locations.

8. A toggle latch as claimed claim 1, wherein the latch arm is a round bar having at one end a tip portion arranged to be exposed for manual lifting for unlatching, and at an opposite end a circular cross-section barrel extending normal to the axis of the arm, wherein the barrel is engaged in a corresponding cavity in the body of the first unit.

9. A toggle latch as claimed in claim 1, wherein the vertical gap is about 1.3 times the diameter of the latch arm and a horizontal gap between the end of the ramp surface and the anterior wall of about 1.3 times the diameter of the latch arm.

10. A toggle latch for latching together first and second structures when in juxtaposition for latching at a closed position, the toggle latch comprising:

a first unit having a body for mounting on the first structure, the body having a receiving cavity with lateral apertures at opposite sides of the body;

a support received in the receiving cavity, the support having a support cavity;

a latch arm having one end mounted on the support cavity and an opposite end projected laterally through one of the apertures of the body, the latch arm is configured to pivot about a latch arm axis;

a second unit for mounting on the second structure and receiving in latching engagement the latch arm, the second unit having a body portion within which a laterally directed aperture is defined for admitting the latch arm and a cavity for retaining the latch arm in latching engagement, the body portion being characterized by a ramp surface profiled to pivot the latch arm upward when impacting thereon, and an interior curved wall defining superior and anterior walls profiled to pivot the latch arm down to an inferior wall in the cavity; and the body portion of each of the first unit and the second unit is molded in plastics material, the first unit is invertible with two spaced supports for the latch arm so that when installed the latch arm may be directed to the left or to the right towards the second unit, and wherein the superior, anterior and inferior walls follow a smooth curve decreasing in radius of curvature generally from the superior wall through the anterior wall to the inferior wall;

wherein the first unit is configured to be invertible so that when installed with respect to the second unit position, the latch arm may be directed to the left or to the right through a respective aperture of the body towards the second unit.

11. A toggle latch as claimed in claim 10 wherein the latch arm is a round bar having at one end a tip portion arranged to be exposed for manual lifting for unlatching, and at an opposite end there is a circular cross-section barrel extending normal to the axis of the arm, wherein the barrel is engaged in a corresponding cavity in the body of the first unit.

12. A toggle latch as claimed in claim 11, wherein the superior wall has a lead-in surface above the ramp surface that extends rearwardly substantially horizontally and smoothly blending into the anterior wall, with a vertical gap between the superior wall and the ramp surface of about 1.3 times the diameter of the latch arm and a horizontal gap between the end of the ramp surface and the anterior wall of about 1.3 times the diameter of the latch arm.

* * * * *